US006404128B1

(12) United States Patent
Kroes

(10) Patent No.: US 6,404,128 B1
(45) Date of Patent: Jun. 11, 2002

(54) GLOW DISCHARGE STARTER

(75) Inventor: Anthony Kroes, Terneuzen (NL)

(73) Assignee: Koninklijke Philips Electronics N.V. (NL)

( * ) Notice: Subject to any disclaimer, the term of this patent is extended or adjusted under 35 U.S.C. 154(b) by 0 days.

(21) Appl. No.: 09/451,274

(22) Filed: Nov. 30, 1999

(30) Foreign Application Priority Data

Nov. 30, 1998 (EP) ..... 98204043

(51) Int. Cl.[7] ..... H01J 7/36

(52) U.S. Cl. ..... 313/619; 313/567; 315/73; 315/47; 337/27

(58) Field of Search ..... 313/619, 637, 313/643, 622, 633, 567, 620; 315/73, 47; 337/22, 23, 24, 25, 26, 27

(56) References Cited

U.S. PATENT DOCUMENTS 2,376,669 A * 5/1945 De Toro ..... 313/619
5,001,391 A * 3/1991 Kilig et al. ..... 313/619
5,317,232 A * 5/1994 Barakitis et al. ..... 313/619
5,512,799 A * 4/1996 Waymouth ..... 313/619
5,872,427 A 2/1999 Kroes ..... 313/636

FOREIGN PATENT DOCUMENTS

| | | |
|---|---|---|
| DE | 1254427 | 11/1967 |
| GB | 1029146 | 5/1966 |

* cited by examiner

*Primary Examiner*—Ashok Patel
(74) *Attorney, Agent, or Firm*—Dicran Halajian

(57) ABSTRACT

In a glow discharge starter, a layer of lanthanum is present on one of the conductors and the gas filling is a Penning mixture. The glow discharge starter does not contain radioactive material. The delay time between the application of a voltage between the conductors and establishing a glow discharge remains short during the whole life of the glow discharge starter, even when the starter was kept in a room with a low light level for a prolonged time.

8 Claims, 1 Drawing Sheet

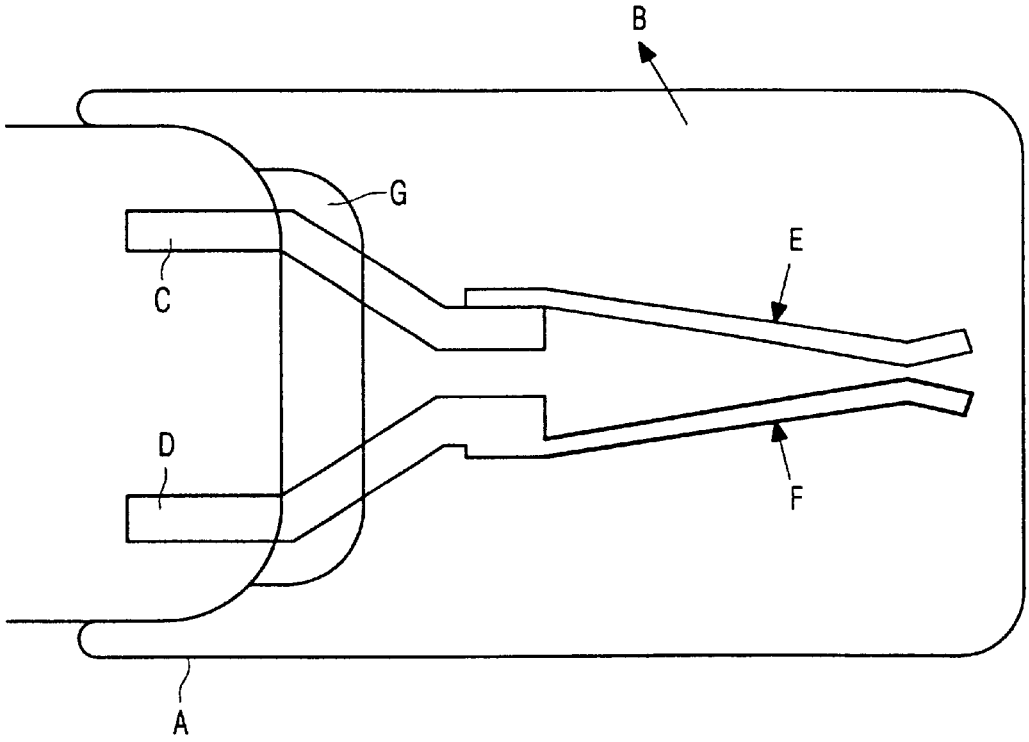
B
G
E
C
D
F
A

GLOW DISCHARGE STARTER

BACKGROUND OF THE INVENTION

The invention relates to a glow discharge starter comprising

- a glass discharge vessel sealed in a gastight manner and provided with an ionizable medium,
- a first and a second electric conductor passing through a wall of the discharge vessel, one of the conductors being in contact with a body comprising an element chosen from the group of lanthanum and the lanthanides,
- a bimetallic element which is conductively connected to one of the electric conductors.

A glow discharge starter of this type is known from German patent specification 1254427. During use for igniting a discharge lamp, the glow discharge starter bridges the discharge lamp and is arranged in series with electrodes of the discharge lamp. Under the influence of a voltage which is present across the discharge lamp and the glow discharge starter, a glow discharge is produced between the electric conductors of the glow discharge starter. This glow discharge heats the bimetallic element connected to one of the electric conductors, which element is deformed under this thermal influence in such a way that it makes contact with the other electric conductor. By establishing this contact, the glow discharge extinguishes and a current flows through the electrodes of the discharge lamp via the electric conductors and the bimetallic element of the glow discharge starter. This current brings the electrodes of the discharge lamp to a temperature at which electron emission occurs to a sufficient extent to hot-ignite the discharge lamp. During heating of the electrodes of the discharge lamp, the bimetallic element of the glow discharge starter cools and is deformed in such a way that the contact between the two electric conductors of the glow discharge starter is interrupted. Due to the interruption of the contact, the current through the electrodes of the lamp is also interrupted, and an inductive element arranged in series with the lamp generates an ignition voltage pulse. If this ignition voltage pulse establishes a discharge between the electrodes of the discharge lamp, the voltage across the discharge lamp and hence the voltage between the electric conductors of the glow discharge starter decreases so strongly that substantially no further glow discharge occurs. However, if the ignition voltage pulse does not establish a discharge between the electrodes of the discharge lamp, the above-described process is repeated.

In the known glow discharge starter, the body comprising an element chosen from the group of lanthanum and the lanthanides is constituted by a layer comprising lanthanum provided on the first electric conductor. Due to the presence of this layer, a glow discharge is established between the two conductors already at a relatively low voltage between these two conductors. For this reason, the known glow discharge starter is suitable for use in situations where the mains voltage has a relatively low amplitude. A drawback of the known glow discharge starter is, however, that it has often proved to be necessary in practice to provide the glow discharge starter with a quantity of radioactive material. With the aid of this radioactive material, a glow discharge is relatively rapidly established after applying a voltage between the two conductors, even if the glow discharge starter has been in a space for a longer time in which only a small quantity of light was present. If the radioactive material is dispensed with, there is an unacceptably long $t_{delay}$, i.e. the time interval between applying the voltage between the two conductors and establishing the glow discharge. Although the radioactive material solves the problem of a too long $t_{delay}$ in an inexpensive and effective manner, it is increasingly considered to be undesirable to make use of radioactive materials in products, notably in products used at such an enormous scale as is the case for glow discharge starters.

SUMMARY OF THE INVENTION

It is an object of the invention to provide a glow discharge starter which does not comprise any radioactive materials and has only a small $t_{delay}$, even after a prolonged stay-in-a-room with a low light level.

According to the invention, a glow discharge starter has a discharge vessel filled with an ionizable medium comprising neon and argon in a ratio of $0.001 \leqq (\text{mol argon})/(\text{mol neon}) \leqq 0.1$.

It has been found that a glow discharge starter according to the invention ignites a discharge lamp rapidly and in a reliable manner, even if no radioactive material is present in the discharge vessel. It has also been found that the contact voltage between the first and the second electric conductor of the glow discharge starter is substantially always higher in practice than the operating voltage of a discharge lamp ignited by the starter. Contact voltage is herein understood to mean the lowest value of the voltage between the first and the second conductor at which the bimetallic element is deformed in such a way that the two electric conductors make contact. Since the operating voltage of the discharge lamp is substantially always lower than the contact voltage of the glow discharge starter, the electric conductors do not make contact during stationary operation of the discharge lamp so that short-circuit of the discharge lamp is prevented.

Very good results were found with glow discharge starters according to the invention in which the molar ratio (mol argon)/(mol neon) was in the range between 0.005 and 0.02.

The body comprising an element from the group of lanthanum and the lanthanides is preferably constituted by a layer comprising lanthanum and covering a part of the first conductor. Such an implementation of the body may be formed in a simple manner by immersing the first conductor in liquid lanthanum. Since the bimetallic element is often not resistant to the temperature of liquid lanthanum, this bimetallic element is conductively connected to the second conductor.

In a glow discharge starter according to the invention, the quantity of filling gas present in the discharge vessel decreases during operation. As a result, the amplitude of the ignition voltage increases at a given current through the conductors before the contact between the conductors is interrupted. Moreover, due to the decrease of the filling gas, the ignition time or duration between switching on the voltage between the conductors of the glow discharge starter and the ignition of the discharge lamp increases. In practice, this means that the initial filling pressure must be chosen to be such that the amplitude of the ignition voltage at this initial filling pressure is high enough to ignite the discharge lamp, while also the ignition time does not become unacceptably long during use of the glow discharge starter. It has been found that these two conditions are met if the filling pressure multiplied by discharge vessel volume is chosen in the range between 7400 and 10,000 Pascal-$cm^3$, preferably between 8250 and 9250 Pascal-$cm^3$.

The part of the wall of the discharge vessel with which the first and the second conductor are in contact is preferably formed from a glass comprising at least 5% by weight of BaO. It has been found that a further decrease of $t_{delay}$ is thereby realized. If this glass is also free from lead, it is also realized that the glass is less harmful for the environment than the frequently used lead-containing glass compositions. Such a glass composition is described in, for example, U.S. Pat. No. 5,872,427.

These and other aspects of the invention are apparent from and will be elucidated with reference to the embodiments described hereinafter.

BRIEF DESCRIPTION OF THE DRAWING

FIG. 1 shows diagrammatically a glow discharge starter according to the invention.

DETAILED DESCRIPTION OF THE PREFERRED EMBODIMENTS

In FIG. 1, a discharge vessel which is sealed in a gastight manner and has a wall of glass without lead and a content of approximately 1.65 $cm^3$. The discharge vessel is filled with an ionizable medium 12 of approximately the following composition: Ar=1%, Ne=99%. The pressure of the ionizable medium is 5065 Pascal at room temperature. First and second electric conductors 14 and 16 pass through a wall of the discharge vessel. The wall is formed in situ by a body 22 consisting of glass without lead, comprising 8.7% by weight of BaO. The electric conductors consist of a core formed from an NiFe alloy and a cladding of Cu.

A bimetallic element 18 is conductively connected to first the electric conductor 14. The bimetallic element consists of an active side formed from Ni (20%), Fe (74%) and Mn (6%) and a passive side formed from Ni (36%) and Fe (64%). A layer 20 formed from lanthanum is provided on a part of the second conductor 16 which forms a pole. The glow discharge starter shown in FIG. 1 comprises no radioactive material.

Table 1 states the average value $t_{delay}$(av.) and the maximum value $t_{delay}$(max) of the $t_{delay}$ of the glow discharge starter shown in FIG. 1 in seconds as a function of the number of switching times and the amplitude of the alternating voltage with which the discharge lamp, across which the glow discharge starter is arranged, is fed. The glow discharge starter was preserved for several days in surroundings in which the light level was only 0.10 lux. The Table shows that both the average value $t_{delay}$(av.) and the maximum value $t_{delay}$(max) remains relatively low during the first 10,000 lamp switchings. A $t_{delay}$(max) of more than one second was measured only if the amplitude of the power supply voltage was only 103 V. For the same glow discharge starter it was found that the amplitude of the ignition voltage during the first 10,000 lamp switchings changed from 1134 V to 1340 V and the ignition time changed from 3.87 to 6.09 sec. These values were measured at a relatively low maximum amplitude of the power supply voltage of approximately 103 V. On this basis, it can be ascertained that both the amplitude of the ignition voltage and the ignition time increase within acceptable limits.

TABLE I

| Number | Amplitude AC voltage | | | |
|---|---|---|---|---|
| | 103 Volt | | 118 Volt | |
| of lamp switchings | $t_{delay}$(av.) | $t_{delay}$(max) | $t_{delay}$(av.) | $t_{delay}$(max) |
| 0 | 0.10 | 0.10 | 0.10 | 0.10 |
| 2000 | 0.11 | 0.14 | 0.10 | 0.10 |
| 4000 | 0.12 | 0.27 | 0.12 | 0.47 |
| 6000 | 0.15 | 0.61 | 0.12 | 0.28 |
| 10000 | 0.20 | 1.09 | 0.18 | 0.71 |

What is claimed is:

1. A glow discharge starter comprising a glass discharge vessel comprising a wall which is sealed in a gastight manner and filled with an ionizable medium, a first electric conductor and a second electric conductor passing through the wall of the discharge vessel, the second conductor being in contact with a body comprising an element chosen from the group of lanthanum and the lanthanides, a bimetallic element which is conductively connected to the first electric conductor, wherein the ionizable medium comprises neon and argon in a ratio of $0.001 \leqq$ (mol argon)/(mol neon) $\leqq 0.1$.

2. A glow discharge starter as claimed in claim 1, wherein the molar ratio (mol argon)/(mol neon) is in the range between 0.005 and 0.02.

3. A glow discharge starter as claimed in claim 1 wherein the body consists of a layer comprising lanthanum and covering a part of the second conductor, and the bimetallic element is conductively connected to the first conductor.

4. A glow discharge starter as in claim 1 wherein said ionizable medium consists of argon and neon.

5. A glow discharge starter as claimed in claim 1, wherein the wall of the discharge vessel comprises a part which is formed from a glass comprising at least 5% by weight of BaO, the first conductor and the second conductor passing through said part.

6. A glow discharge starter as claimed in claim 5, wherein the glass contains no lead.

7. A glow discharge starter as in claim 1, wherein the filling pressure multiplied by discharge vessel volume is chosen in the range between 7400 and 10,000 Pascal-$cm^3$.

8. A glow discharge starter as in claim 7, wherein the filling pressure multiplied by discharge vessel volume is chosen in the range between 8250 and 9250 Pascal-$cm^3$.

* * * * *